US011768060B2

(12) United States Patent
Kirsch

(10) Patent No.: US 11,768,060 B2
(45) Date of Patent: Sep. 26, 2023

(54) ARROW OR BOLT HAVING AN ADVANCED CROSSBOW PIN AND PIN NOCK

(71) Applicant: Kirsch, LLC, Burlington, WI (US)

(72) Inventor: Phillip Kirsch, Burlington, WI (US)

(73) Assignee: Kirsch LLC, New Munster, WI (US)

( * ) Notice: Subject to any disclaimer, the term of this patent is extended or adjusted under 35 U.S.C. 154(b) by 0 days.

(21) Appl. No.: 17/675,715

(22) Filed: Feb. 18, 2022

(65) Prior Publication Data

US 2022/0260349 A1 Aug. 18, 2022

Related U.S. Application Data

(60) Provisional application No. 63/150,645, filed on Feb. 18, 2021.

(51) Int. Cl.
*F42B 6/06* (2006.01)
*F41B 5/12* (2006.01)

(52) U.S. Cl.
CPC . *F42B 6/06* (2013.01); *F41B 5/12* (2013.01)

(58) Field of Classification Search
CPC ..... F41B 5/1415; F42B 6/06
See application file for complete search history.

(56) References Cited

U.S. PATENT DOCUMENTS 1,785,589 A * 12/1930 Mead ..... F42B 6/06 124/91
3,010,446 A * 11/1961 Frantello ..... F41B 5/1415 473/578
5,067,731 A * 11/1991 Bickel ..... F42B 6/06 473/578
5,154,432 A * 10/1992 Saunders ..... F42B 6/06 473/578
5,465,979 A * 11/1995 Buhler ..... F42B 6/06 473/578
5,897,449 A * 4/1999 Roberts ..... F42B 10/26 473/586
5,915,105 A * 6/1999 Farmwald ..... G11C 7/1045 711/E12.089
5,919,105 A * 7/1999 Summers ..... F42B 6/06 473/578
6,213,114 B1 * 4/2001 Burkhart ..... F42B 6/06 124/91
8,821,325 B2 * 9/2014 Kirsch ..... F42B 12/385 473/578
9,441,925 B1 * 9/2016 Palomaki ..... F42B 6/04
2021/0262773 A1 * 8/2021 Kirsch ..... F42B 12/382

* cited by examiner

*Primary Examiner* — John A Ricci
(74) *Attorney, Agent, or Firm* — K&L Gates LLP

(57) ABSTRACT

A pin nock assembly comprises a pin and nock. The pin includes a pin base, a pin element positioned laterally away from the pin base, and a pin collar positioned between the pin base and pin element. The pin element protrudes laterally from the pin collar along a central axis. The central axis extends from a center of the pin base through a center of the pin element. The nock includes a nock base and a string interface positioned laterally away from the nock base. The nock base defines a pin cavity complementary to and configured to receive the pin element. A base portion of the nock base is positioned around the pin cavity and is configured to abut the pin collar when the pin element is inserted into the pin cavity. The string interface is configured to contact a string of a crossbow.

22 Claims, 6 Drawing Sheets

ARROW OR BOLT HAVING AN ADVANCED CROSSBOW PIN AND PIN NOCK

CROSS REFERENCE TO RELATED APPLICATIONS

This application claims the benefit of priority to U.S. Provisional Application No. 63/150,645 filed Feb. 18, 2021, the entire contents of which are expressly incorporated herein by reference thereto.

TECHNICAL FIELD

The disclosures herein relate generally to an apparatus for archery. More specifically, a pin positioned on a rear portion of an arrow or bolt and a complementary pin nock that are configured for use with a crossbow and crossbow applications.

BACKGROUND

Vertical bows (e.g., long bows, recursive bows, compound bows) may employ a nock at the end of the arrow or bolt to assist a user in: readying the arrow on the string of the bow, drawing the bow, and firing the arrow or bolt. Typically, nocks for vertical bows are thin to be able to fit between the shooter's fingers or include a D-shaped loop which manually holds the string of the vertical bow. Horizontal bows or crossbows differ from vertical bows in a number of ways, which result in different considerations and configurations for arrows or bolts used in crossbow application than arrows or bolt used in vertical bow applications. For example, crossbow applications differ in the method of drawing the string back, have greater string diameters, have an increased strength required for drawing the crossbow, and have a greater firing speed that the crossbow string travels. Accordingly, arrows and nocks for crossbow application are configured differently from nocks used for vertical bows. The use of nocks that are insert (e.g., press-fit) nocks specifically tailored for crossbow applications are known in the hunting and archery industry as being ideal for the considerations of firing arrows or bolts from horizontal bows.

SUMMARY

The present inventor recognized that the shape of a nock for use with an arrow or bolt is dictated by the function of the nock to grip the bowstring and that nocks for crossbow applications have to be configured for different considerations than nocks for vertical bow applications. For example, it would be unrealistic and likely unsafe to shoot a crossbow with nocks created for the purpose to be used in vertical bows as nocks for vertical bows are configured for much slower firing and substantially less energy to accommodate. Furthermore, to the best knowledge of the present inventor, all known crossbow nocks employ insert nocks, which are nocks inserted into an opening at the end of the arrow or bolt. Insert nocks are implemented in crossbow applications to accommodate the increased strength to take the higher speeds and energy from the crossbow and deal with the larger strings and holding onto the string when the string is released from its mechanical cocked position. The result of this known design is that the crossbow arrow or bolt may be fit with a nock that slides into a nock post inside the arrow shaft and is press fit into the arrow shaft until the shaft end contacts the insert nock. While vertical bows and vertical bow applications utilize overnocks (e.g. outsert nocks), cone nocks, and pin nocks, it would be unwise and potentially dangerous to use nocks configured for vertical bow applications and vertical bow characteristics as the nock for vertical application may break, split, or shatter when launched with a crossbow, due to the increased cocking and firing energies.

However, the present inventor implemented a pin on a rearward facing end of the arrow or bolt configured to receive a pin nock, with the pin and pin nock specifically designed for crossbow firing applications. The present inventor discovered that a pin nock with thicker nock ears and/or nock walls and with a large seat for interface with a shoulder of the pin advantageously provides a nock that can interface with the thicker string diameter of the crossbow and handle the high energies released when firing the crossbow. Such a pin nock and pin is superior to insert nocks and/or vertical nocks because the pin nock and pin configuration of the present concept provides an extremely accurate nock to bolt connection while also providing additional protection to the rear of the bolt shaft, for example, when a second arrow shot into a target collides with a first arrow shot into the same target.

DETAILED DESCRIPTION

Definitions

Figure 1:
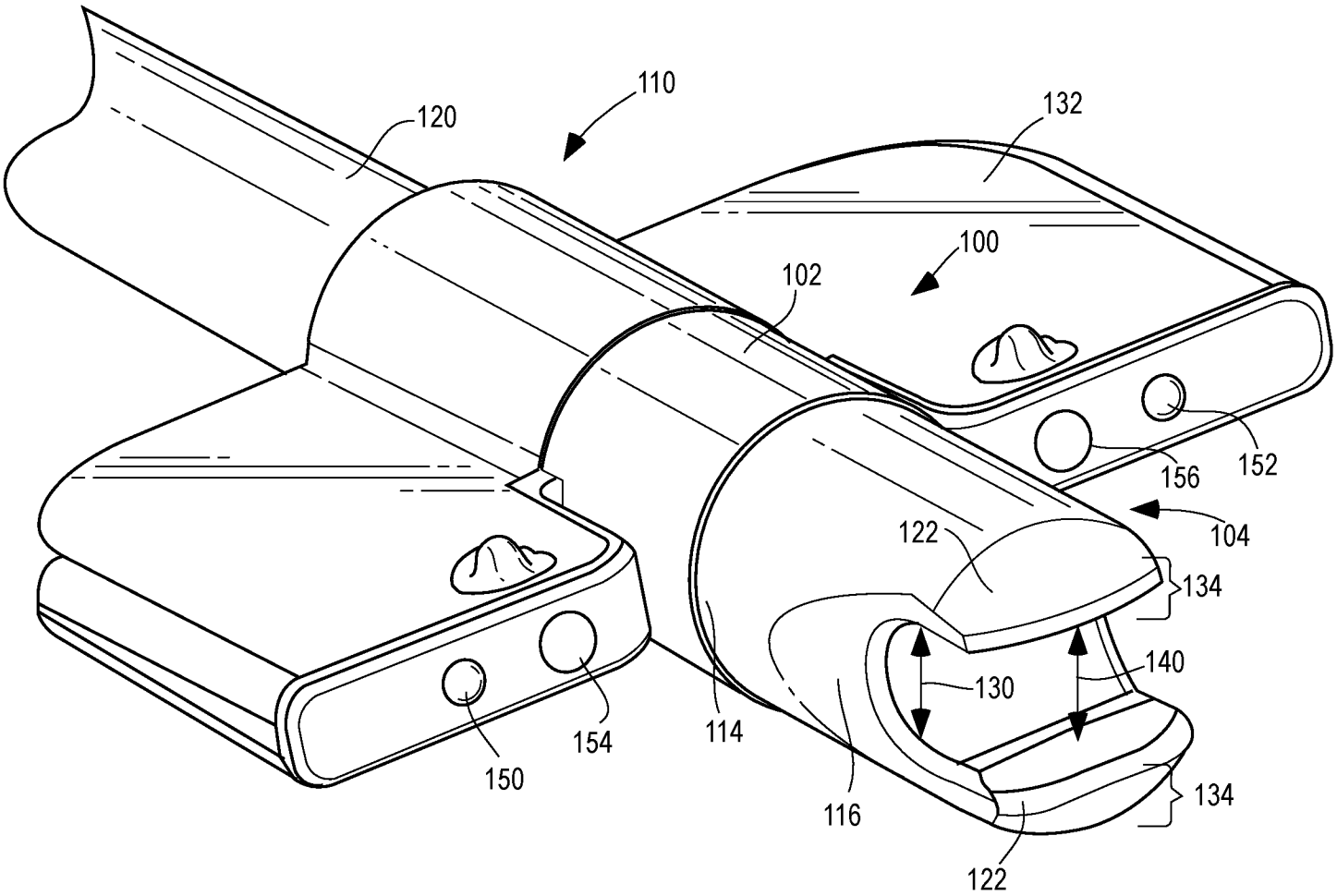
FIG. 1 is a rear perspective view of an embodiment of a pin nock and pin assembly according to the present disclosure.

Some definitions are provided hereafter. Nevertheless, definitions may be located in the "Embodiments" section below, and the above header "Definitions" does not mean that such disclosures in the "Embodiments" section are not definitions.

As used herein, "about," "approximately," "essentially" and "substantially" are understood to refer to numbers in a range of numerals, for example the range of −10% to +10% of the referenced number, preferably −5% to +5% of the referenced number, more preferably −1% to +1% of the referenced number, even more preferably 0.1% to +0.1% of the referenced number, most preferably −0.01% to +0.01% of the referenced number. A range disclosed "between" two values is inclusive of the noted values. Moreover, these numerical ranges should be construed as providing support for a claim directed to any number or subset of numbers in that range. For example, a disclosure of from 1 to 10 should be construed as supporting a range of from 1 to 8, from 3 to 7, from 1 to 9, from 3.6 to 4.6, from 3.5 to 9.9, and so forth.

As used herein and in the appended claims, the singular form of a word includes the plural, unless the context clearly dictates otherwise. Thus, the references "a," "an" and "the" are generally inclusive of the plurals of the respective terms. For example, reference to "a light emitting element" or "the light emitting element" includes a plurality of such "light emitting elements." The term "and/or" used in the context of "X and/or Y" should be interpreted as "X," or "Y," or "X and Y." Similarly, "at least one of X or Y" should be interpreted as "X," or "Y," or "both X and Y."

The words "comprise," "comprises," and "comprising" are to be interpreted inclusively rather than exclusively. Likewise, the terms "include," "including" and "or" should all be construed to be inclusive, unless such a construction is clearly prohibited from the context. However, the embodiments provided by the present disclosure may lack any element that is not specifically disclosed herein. Thus, a disclosure of an embodiment defined using the term "comprising" is also a disclosure of embodiments "consisting essentially of" and "consisting of" the disclosed components.

Where used herein, the term "example," particularly when followed by a listing of terms, is merely exemplary and illustrative, and should not be deemed to be exclusive or comprehensive. Any embodiment disclosed herein can be combined with any other embodiment disclosed herein unless explicitly indicated otherwise.

Embodiments

The present disclosure provides a pin nock assembly including a pin and pin nock for archery, such as hunting game. The pin nock assembly can be configured to position a pin nock on a shoulder of a pin positioned on a rear end of the arrow or bolt. For example, the collar or shoulder of the pin coupled to the arrow or bolt can receive a base portion of a pin nock to position the pin nock to interface with the crossbow string and provide a balanced and safe firing of the arrow or bolt. The pin nock assembly is configured with a thickness to withstand crossbow firing energies and to interface with the thicker diameter crossbow strings.

Further, the pin nock assembly provides a pin that projects rearward and is substantially centered along a central axis. In some embodiments, the pin is made of aluminum, or a similar metal alloy and/or metal, to provide a sturdy structure without unnecessarily adding weight to, or unbalancing, the arrow or bolt. The pin and pin collar (e.g., area around the base of the protruding pin) are configured to protect the rear portion of the arrow or bolt from damage from a subsequently fired arrow or bolt. For example, when a second arrow collides with a first arrow with the pin nock of the present disclosure, the pin and pin collar deflect (e.g., steer) the second incoming arrow away from the rear of the first arrow shaft. Relatedly, the pin nock is configured for a compression fit into the pin and is configured to maintain arrow or bolt balance and facilitate, with the pin, deflection of a subsequently fired arrow or bolt.

The pin nock is part of a pin nock assembly comprising a notch configured to interact with a crossbow string. In some embodiments, the pin nock is part of a pin nock assembly comprising a v-shaped interface configured to interact with a crossbow string. In one embodiment, the pin nock is part of a pin nock assembly comprising a substantially flat interface configured to interact with a crossbow string. The pin nock may be configured with a sufficient base pin opening and base portion to receive the pin and rest upon the pin collar (e.g., area around the pin), respectively. In some embodiments, the pin nock includes a thick diameter along the nock ears. In other embodiments, the pin nock comprises a lightweight metal or metal alloy.

The pin is part of a pin nock assembly comprising a protruding pin element and a pin collar configured to interact with a complementary pin nock. In some embodiments, the pin is part of a pin nock assembly comprising a cylindrical base configured to press fit within the rear end of an arrow or bolt. In other embodiments, the pin is formed along a rear end of an arrow or bolt. The pin may be configured to interface with a pin nock to allow the archer to safely launch the arrow or bolt from the crossbow and impede the launched arrow or bolt from being damaged from a rearward strike by a subsequently fired arrow or bolt.

FIG. 1 generally depicts a non-limiting embodiment of a pin nock assembly 100 according to the present disclosure. The pin nock assembly 100 comprises a pin 102 and a complementary pin nock 104 inserted over the pin 102. The pin nock assembly 100 is used with an arrow or bolt 110. The pin nock assembly 100 is positioned on a rearward facing end (e.g., rear end) of the shaft 120 of the arrow or bolt 110. In some embodiments, the pin nock assembly 100 may be positioned between a pair of wings 132 that are positioned around the rear end of the shaft 120 such that the pair of wings 132 are adjacent a portion of the pin 102 of the pin nock assembly 100. A central axis of the arrow or bolt 110 extends through a tip of the arrow or bolt, centrally along the shaft 120 of the arrow or bolt 110 toward and through a center of the pin nock assembly 100.

The pin nock 104 is positioned on the central axis of the arrow or bolt 110 on the pin 102 of the pin nock assembly 100. The pin nock 104 comprises a nock base 114 adjacent the pin 102 and a string interface portion configured as a pair of nock ears 122 extending from the nock base 114 away from the shaft 110. The nock base 114 is positioned laterally from the pair of nock ears 122 that comprise the string interface portion. As used herein, laterally is a direction substantially similar to the direction of the central axis. In other words, extending or positioned laterally refers to extending or being positioned along a direction substantially parallel to the central axis. The nock base 114 and the pair of nock ears 122 may be formed as a single unit and configured to handle larger string diameters and firing energies of crossbow applications.

The nock base 114 extends laterally from an end adjacent the pin 102 toward the pair of nock ears 122. The nock base 114 defines an internal cavity configured to receive the pin 102. The nock base 114 has a diameter that is substantially similar to the diameter of the pin 102 and/or the diameter of the shaft 120 of the arrow or bolt. The nock base 114 includes a solid base portion positioned around the internal cavity that is complementary to a pin collar 210 of the pin 102. The base portion is configured to interface with the pin collar 210 to provide a surface area sufficient to impede the pin 102 from splitting, cracking, or damaging the pin nock 104 when the arrow or bolt 110 is fired from the crossbow.

The nock base 114 comprises a material configured to withstand the high speed and energy of a crossbow. In some embodiments, the walls of the nock base 114 are comprised of a plastic and/or polycarbonate material. In such embodiments, the nock base 114 preferably has a diameter between 0.300 inch and 0.350 inch, and/or the wall thickness may be between 0.0875 inch and 0.350 inch. In other embodiments, the walls of the nock base 114 are comprised of a metal or metal alloy, and the nock base 114 can have a thinner diameter than a plastic nock base 114. In such embodiments, the nock base 114 preferably has a diameter between 0.165 inch and 0.350 inch, and/or the wall thickness may be between 0.01 inch and 0.350 inch.

The string interface end comprises a pair of nock ears 122 that extend from the nock base 114 and define an internal string cavity 130. In other words, the base end (e.g., the end adjacent the nock base 114) of the pair of nock ears 122 couple to define the curved internal string cavity 130. The outer portion of the nock ears 122 may be flush with the walls of the nock base 114, in other words, the outer diameter of nock ears 122 may be similar to the outer diameter of the nock base 114.

The internal string cavity 130 is configured to receive a string of a crossbow. An ear gap 140 is defined between a first ear and second ear in the pair of nock ears 122 and is positioned rearward to the internal string cavity 130. In other words, an outer end (e.g., opposite the base end) of the first ear and an outer end of the second ear may be positioned axially away from each other to defined an ear gap 140. A crossbow string can pass through the ear gap 140 and come to rest into the internal strong cavity 130 as the arrow or bolt 110 is loaded and drawn to cock the crossbow. In some embodiments, the internal string cavity 130 has a greater diameter than the width of the ear gap 140. In other embodiments, the internal string cavity 130 has a substantially similar diameter to the width of the ear gap 140.

The area defining the internal cavity 130 and/or the ear gap 140 may be substantially the same diameter as the crossbow string. In some embodiments, the pin nock 104 comprises adjustable nock ears and/or internal string cavity to accommodate a wide range of crossbow string diameters. In other embodiments, the internal string cavity 130 diameter and the width of the ear gap 140 are configured to accommodate a wide range of crossbow string diameters. The internal cavity 130 and/or the ear gap 140 may be substantially smooth to minimize friction and catch of the surface with the string of the crossbow.

The internal string cavity 130 and the pair of nock ears 122 are configured to receive and interface (e.g., press against) with a string of a crossbow when the crossbow is in a cocked position (e.g., ready to fire) and when the crossbow is fired. The pair of nock ears 122 have an ear diameter 134 and thickness to provide for safe firing and usage of the pin nock 104 with crossbow applications. In some embodiments, the internal string cavity 130 defines an inside angle between a center point of the internal string cavity 130 and a portion of the surface that defines the internal string cavity 130. The inside angle may be configured to direct the crossbow string speed and energy during firing into the body of the pin nock 104 and away from the pair of nock ears 122.

The pair of nock ears 122 comprise a material configured to withstand the high speed and energy of a crossbow. In some embodiments, the walls of the pair of nock ears 122 are comprised of a plastic and/or polycarbonate material. In such embodiments, the pair of nock ears 122 preferably has a diameter between 0.300 inch and 0.350 inch, and/or the wall thickness may be between 0.020 inch and 0.118 inch. In other embodiments, the walls of the pair of nock ears 122 are comprised of a metal or metal alloy, and the pair of nock ears 122 can have a thinner diameter than a plastic pair of nock ears 122. In such embodiments, the pair of nock ears 122 preferably has a diameter between 0.165 inch and 0.350 inch, and/or the wall thickness may be between 0.0125 inch and 0.118 inch.

The pin nock 104 may comprise an indexing tab or nub on the side of the pin nock 104 diameter to indicate to the user the orientation of the pin nock as it relates to the crossbow bolt. For example, the indexing tab or nub may be positioned on a nock ear of the pair of nock ears 122. In some embodiments, the indexing tab or nub may be positioned may be positioned along a flared portion 116 between the nock base 114 and the pair of nock ears 122.

Figure 2:
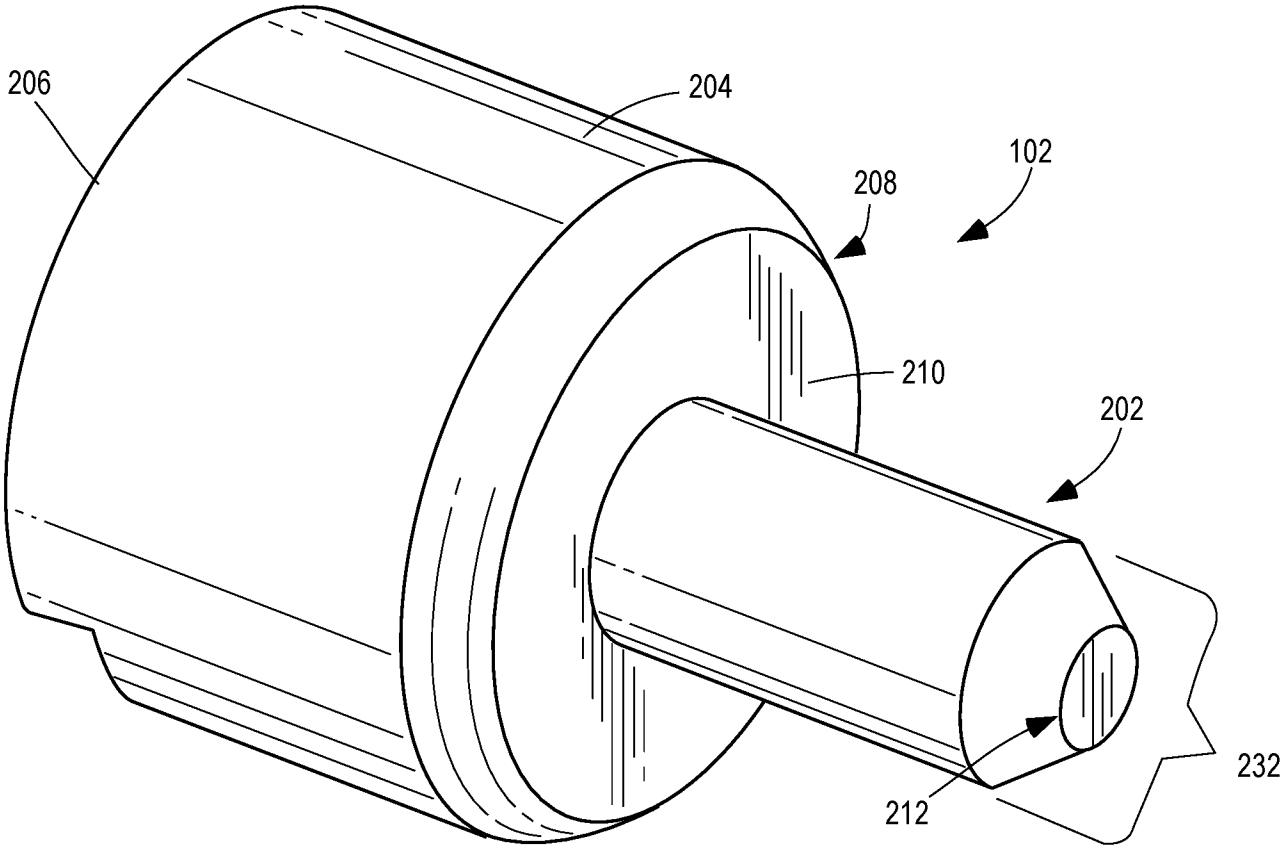
FIG. 2 is a rear perspective view of an embodiment of a pin for the pin nock assembly according to the present disclosure.

FIG. 2 generally depicts a non-limiting embodiment of the pin 102 according to the present disclosure. The pin 102 may be the implemented as the pin of the pin nock assembly 100 or with the pin nocks 304, 404 of FIGS. 3 & 4 to form a pin nock assembly. The pin 102 is positioned on the central axis of the arrow or bolt 110 on a rearward end portion of the shaft 120. The pin 102 comprises a pin base 204, a protruding pin element 202, and a pin collar 210 positioned between the pin base 204 and the protruding pin element 202. The pin base 204, protruding pin element 202, and/or the pin collar 210 may comprise the same material, for example, a metal or metal alloy or, in some embodiments, may be comprised of a plastic and/or polycarbonate material. In some embodiments, the protruding pin element 202 and the pin base 204 are formed with different materials.

The pin base 204 is adjacent the shaft 120 of the arrow or bolt 110 and is configured to engage the shaft 120. In some embodiments, the pin base 204 has a diameter smaller than the diameter of the shaft 120 and is configured to be press-fit into a cavity at the rear end of the shaft 120. In those embodiments, the pin base 204 may be substantially solid internally. In other embodiments, the pin base 204 has a diameter greater than the diameter of the shaft 120 and is configured to be fitted over the rear end of the shaft 120. In those embodiments, the pin base 204 defines an internal cavity to receive the end of the shaft 120. In some embodiments, the pin base 204 is formed as a single unit with the shaft 120 of the arrow or bolt 110 such that the diameter of the pin base 204 and the diameter of the shaft 120 are substantially the same. In those embodiments, the pin base 204 may be substantially solid internally.

The pin collar 210 extends radially and substantially perpendicular to the central axis. As used herein, radially is traverse to the lateral direction. The pin collar 210 abuts the nock base 114 when protruding pin element 202 is inserted into the pin nock 104. The pin collar 210 is configured to have a diameter and structure to receive forces of the firing crossbow string through the pin nock 104 and disperse them throughout the pin 102 to minimize the force on the protruding pin element 202. Having the pin collar 210 with a large base to contact the pin nock 104 and distribute forces through the pin nock 104 decreases the chance of the protruding pin element 202 splitting, fracturing, or damaging the pin nock 104 during firing of the crossbow.

The pin collar 210 may include an inwardly (e.g., toward the central axis) flared portion 208 such that diameter of the pin collar 210 is less than diameter of the pin base 204. The flared portion 208 may be positioned at an angle (with respect to the central axis) and configured to receive firing forces through the pin nock 104 and disperse them throughout the pin 102 to minimize the force on the protruding pin element 202. In other embodiments, the pin collar 210 may be flush with the pin base 204.

In some embodiments, the pin collar 210 is configured for deflection of a subsequently fired arrow. For example, the pin collar 210 may comprise a metal or metal allow material and have surface configured such that a subsequently fired arrow is steered away from the shaft 120 and other portions of the arrow or bolt 110. Beneficially, the pin collar 210 mitigates damage to the arrow or bolt 110 and allow for reuse of the arrow or bolt 110.

The protruding pin element 202 extends laterally (e.g., substantially along the central axis) from the pin collar 210 in a direction away from the pin base 204. The protruding pin element 202 may be centered along the central axis such that the midpoint of the diameter 232 of the protruding pin element 202 is on the central axis. The protruding pin element 202 is configured to receive a complementary nock, for example, the pin nocks 104, 304, 404 of FIGS. 1, 3, & 4.

The protruding pin element 202 may comprise a material such as a plastic and/or polycarbonate material or a metal or metal alloy. The diameter 232 of the protruding pin element 202 may be, for example, between 0.125 inch to 0.128 inch.

The protruding pin element 202 may comprise a flared, half-cone tip 212. The tip 212 may be configured for increasing the deflection of a subsequently fired arrow away from the pin nock assembly 100 and the arrow or bolt 110. In other embodiments, the tip may be flat, pointed, rectangular, or angled.

Figure 3:
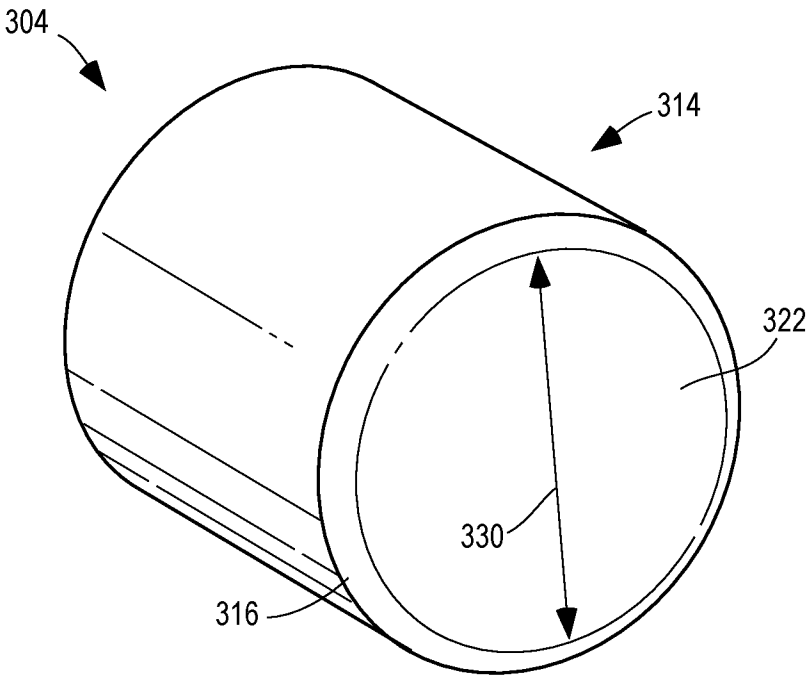
FIG. 3 is a rear perspective view of an embodiment of a flat pin nock according to the present disclosure.

FIG. 3 generally depicts a non-limiting embodiment of a flat pin nock 304 according to the present disclosure. The flat pin nock 304 may be implemented with and inserted over a pin 102 of the pin nock assembly 100 of FIG. 1. The pin nock 304 is positioned on the central axis of the arrow or bolt 110 on the pin of the pin nock assembly 100. The pin nock 304 comprises a nock base 314 adjacent the pin and a flat nock surface 322 that is substantially flat and extends perpendicular to the central axis. The nock base 314 and the flat nock surface 322 are formed as a single unit and are configured to handle larger string diameters and firing energies of crossbow applications. The flat nock surface 322 may be implemented to minimize wear and tear on the crossbow string.

The nock base 314 defines an internal cavity configured to receive the pin. The nock base 314 has a diameter that is substantially similar to the diameter of the pin and/or the diameter of the shaft 320 of the arrow or bolt. The nock base 314 includes a solid base portion positioned around the internal cavity that is complementary to a pin collar 230 of the pin. The base portion is configured to interface with the pin collar 230 to provide a surface area sufficient to impede the pin from splitting, cracking, or damaging the pin nock 304 when the arrow or bolt 110 is fired from the crossbow. The base portion is large enough to contact the pin nock 304 and distribute forces through the pin nock 304, thereby decreasing the chance of the protruding pin element 202 splitting, fracturing, or damaging the pin nock 104 during firing of the crossbow The nock base 314 comprises a material configured to withstand the high speed and energy of a crossbow. In some embodiments, the walls of the nock base 314 are comprised of a plastic and/or polycarbonate material. In such embodiments, the nock base 314 preferably has a diameter between 0.300 inch and 0.350 inch, and/or the wall thickness may be between 0.0875 inch and 0.350 inch. In other embodiments, the walls of the nock base 314 are comprised of a metal or metal alloy, and the nock base 314 can have a thinner diameter than a plastic nock base 314. In such embodiments, the nock base 314 preferably has a diameter between 0.165 inch and 0.350 inch, and/or the wall thickness may be between 0.01 inch and 0.350 inch.

The flat nock surface 322 extends around the nock base 314 and forms a flat circular surface having a diameter 330 and configured to receive a string of a crossbow. The diameter 330 of the flat nock surface 322 may be less than the diameter of the nock base 314 such that a rounded portion 316 is between the nock base 114 and the pair of nock ears 122. The flat nock surface 322 is configured to receive and interface (e.g., press against) with a string of a crossbow when the crossbow is in a cocked position (e.g., ready to fire) and when the crossbow is fired. In some embodiments, the rounded portion 316 defines an inside angle between a center point of flat nock surface 322 and a portion of the surface that defines the rounded portion. The inside angle may be configured to direct the crossbow string speed and energy during firing into the body of the pin nock 304 and away from the flat nock surface 322.

Figure 4:
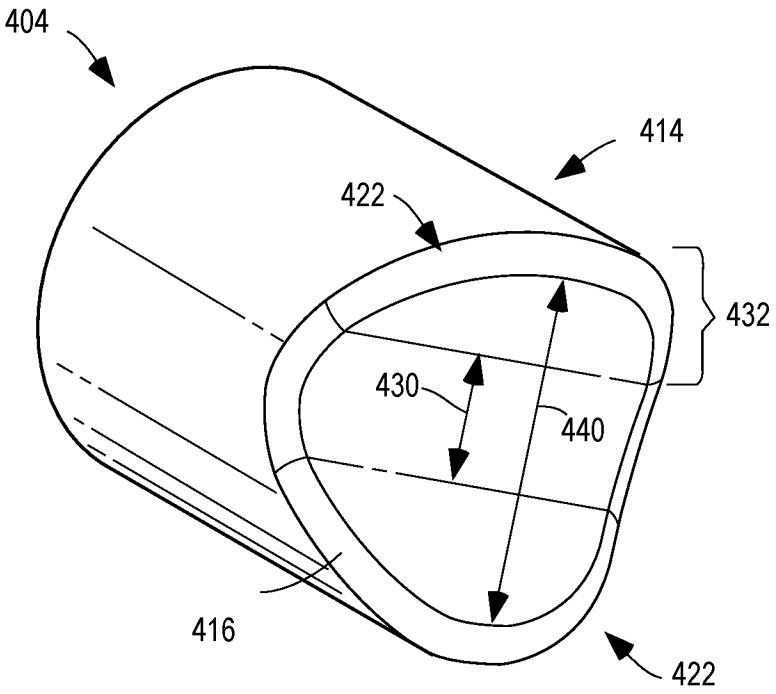
FIG. 4 is a rear perspective view of an embodiment of a v-shaped pin nock according to the present disclosure.

FIG. 4 generally depicts a non-limiting embodiment of a v-shaped pin nock 404 according to the present disclosure. The v-shaped pin nock 404 may be implemented with and inserted over a pin 102 of the pin nock assembly 100 of FIG. 1. The v-shaped pin nock 404 is positioned on the central axis of the arrow or bolt 110 on the pin of the pin nock assembly 100. The pin nock 404 comprises a nock base 414 adjacent the pin and a pair of nock ears 422 extending from the nock base 414 away from the shaft 110. The nock base 414 and the pair of nock ears 422 are formed as a single unit and are configured to handle larger string diameters and firing energies of crossbow applications.

The nock base 414 defines an internal cavity configured to receive the pin. The nock base 414 has a diameter that is substantially similar to the diameter of the pin and/or the diameter of the shaft 420 of the arrow or bolt. The nock base 414 includes a solid base portion positioned around the internal cavity that is complementary to a pin collar 240 of the pin. The base portion is configured to interface with the pin collar 240 to provide a surface area sufficient to impede the pin from splitting, cracking, or damaging the pin nock 404 when the arrow or bolt 110 is fired from the crossbow. The base portion is large enough to contact the pin nock 104 and distribute forces through the pin nock 404, thereby decreasing the chance of the protruding pin element 202 splitting, fracturing, or damaging the pin nock 104 during firing of the crossbow The nock base 414 comprises a material configured to withstand the high speed and energy of a crossbow. In some embodiments, the walls of the nock base 414 are comprised of a plastic and/or polycarbonate material. In such embodiments, the nock base 414 preferably has a diameter between 0.300 inch and 0.350 inch, and/or the wall thickness may be between 0.0875 inch and 0.350 inch. In other embodiments, the walls of the nock base 414 are comprised of a metal or metal alloy, and the nock base 414 can have a thinner diameter than a plastic nock base 414. In such embodiments, the nock base 414 preferably has a diameter between 0.165 inch and 0.350 inch, and/or the wall thickness may be between 0.01 inch and 0.350 inch.

The pair of nock ears 422 extend from the nock base 414 and define an internal string cavity 430 configured to receive a string of a crossbow. The pair of nock ears 422 extend from an internal string cavity 430 at an angle such that the outer portion of the nock ears 422 are substantially flush with the nock base 414. The pair of nock ears 422 may form a wide "v" shape. An ear gap 440 is defined between a first ear and second ear in the pair of nock ears 422 and is positioned rearward to the internal string cavity 430. In other words, a crossbow string would pass through the ear gap 440 and come to rest into the internal strong cavity 430 as the arrow or bolt 110 is loaded and drawn to cock the crossbow.

The area defining the internal cavity 430 may be substantially the same diameter as the crossbow string. In some embodiments, the pin nock 404 comprises adjustable nock ears and/or internal string cavity to accommodate a wide range of crossbow string diameters. In other embodiments, the internal string cavity 430 diameter and the width of the ear gap 440 are configured to accommodate a wide range of crossbow string diameters. The internal cavity 430 and/or the ear gap 440 may be substantially smooth to minimize friction and catch of the surface with the string of the crossbow.

The internal string cavity 430 and the pair of nock ears 422 are configured to receive and interface (e.g., press against) with a string of a crossbow when the crossbow is in a cocked position (e.g., ready to fire) and when the crossbow is fired. The pair of nock ears 422 have an ear diameter 432 and thickness to provide for safe firing and usage of the pin nock 404 with crossbow applications. In some embodiments, the internal string cavity 430 defines an inside angle between a center point of the internal string cavity 430 and a portion of the surface that defines the internal string cavity 430. The inside angle may be configured to direct the crossbow string speed and energy during firing into the body of the pin nock 404 and away from the pair of nock ears 422.

The pair of nock ears 422 comprise a material configured to withstand the high speed and energy of a crossbow. In some embodiments, the walls of the pair of nock ears 422 are comprised of a plastic and/or polycarbonate material. In such embodiments, the pair of nock ears 422 preferably has a diameter between 0.300 inch and 0.350 inch, and/or the wall thickness may be between 0.020 inch and 0.118 inch. In other embodiments, the walls of the pair of nock ears 422 are comprised of a metal or metal alloy, and the pair of nock ears 422 can have a thinner diameter than a plastic pair of nock ears 422. In such embodiments, the pair of nock ears 422 preferably has a diameter between 0.165 inch and 0.350 inch, and/or the wall thickness may be between 0.0125 inch and 0.118 inch.

In some embodiments, the pin nock assembly 100 comprises at least one connecting feature configured to facilitate the connection of the crossbow string and the internal string cavity 130 of the pin nock 104. The pin nock assembly 100 may comprise a translatable safety feature that has a "safety on" state where the crossbow is unable to fire and a "safety off" state where the crossbow is able to fire.

The pin nock assembly 100 may comprise weighted portions to increase or adjust flight distance and path of the arrow or bolt 110. In those embodiments, an integrated weight system may be implemented within the nock ears 122 and/or the nock base 114. In some embodiments, the flight of the arrow or bolt 110 may be altered or adjusted by adding one or more vanes along the outer surface of the pin 102 and/or pin nock 104.

In some embodiments, the pin nock assembly 100 comprises a sound emitting source to transmit sound and other information to a shooter of the crossbow. The pin nock assembly 100 may comprise a radio frequency, smoke emitter, or other information transmitting device(s) to transmit information to a shooter of the crossbow. In some embodiments, the pin nock assembly 100 comprises a warning or status condition transmitting device integrated therewithin. For example, the condition device may transmit to a user or user device a status of a component of the pin nock assembly 100 or arrow or bolt 110.

In some embodiments, the pin nock assembly 100 comprises an illumination assembly with at least one light emitting element. Each of the at least one light emitting element can be a light-emitting diode or any suitable light source that emits light, preferably when current runs through the light emitting element. In some embodiments, the pin 102 and/or the pin nock 104 are translucent or transparent to allow light through from a light emitting source. The illumination assembly may comprise a light emitting element 150 and a counterweight 152 on an opposite side of the pin nock assembly 100 from the light emitting element, preferably approximately one hundred eighty degrees from each other. The counterweight 152 and the light emitting element 150 are preferably collinear on a virtual line that is substantially perpendicular to the central axis of the arrow or bolt. In some embodiments, the pin nock assembly 100 comprises one or more power charging element 154, 156 for charging the light emitting element.

In a non-limiting embodiment, the pin nock assembly 100 is part of or can be connected to one of the embodiments of the detachable tracking apparatus disclosed by U.S. Pat. No. 8,821,325 to Kirsch, entitled "Detachable Apparatus for Securing a Transmitting Device for use with a Hunting Arrow for Tracking Game," herein incorporated by reference in its entirety.

Figure 5:
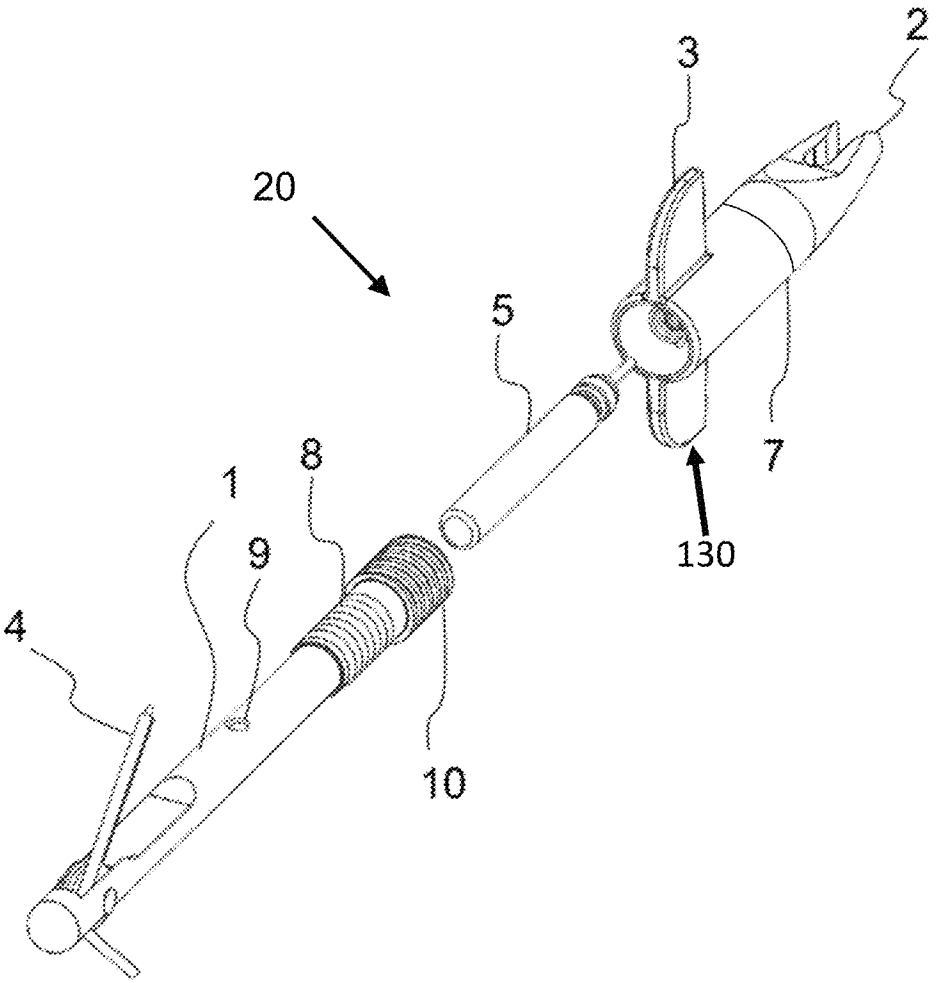
FIG. 5 is an exploded perspective view of an embodiment of a detachable tracking apparatus.
Figure 6:
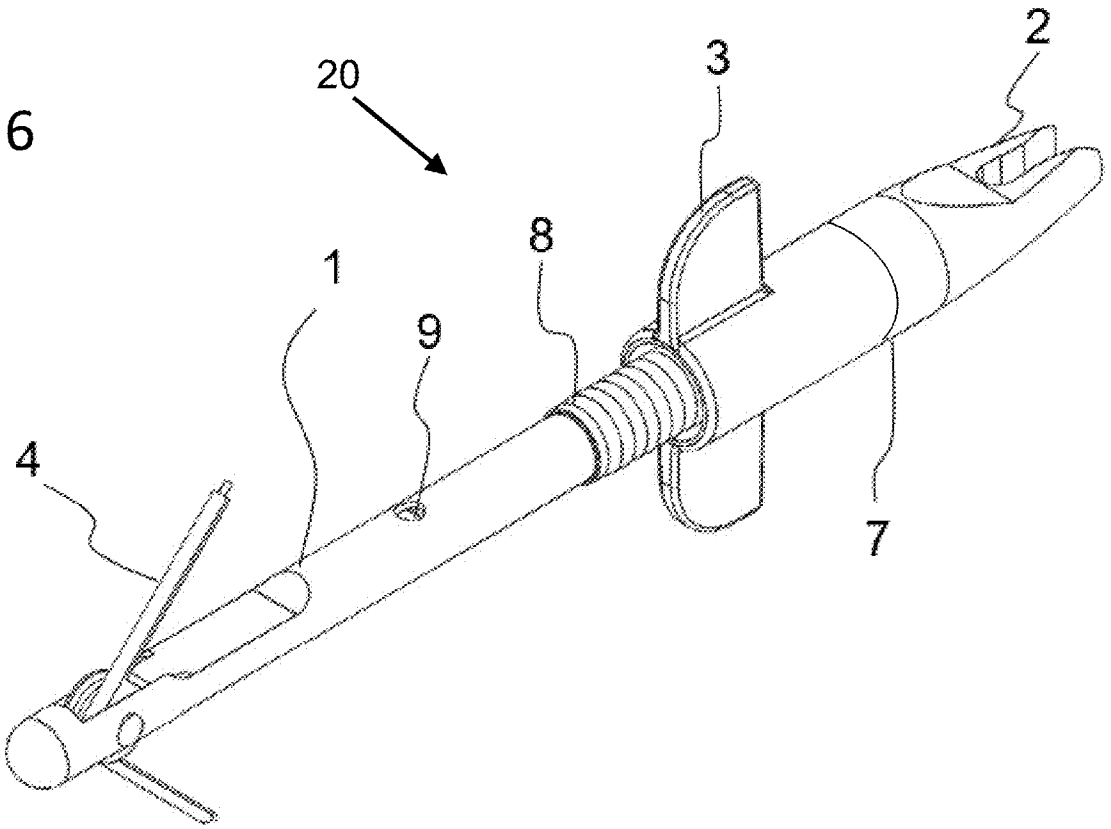
FIG. 6 is an exploded perspective view of an embodiment of a detachable tracking apparatus.
Figure 7:
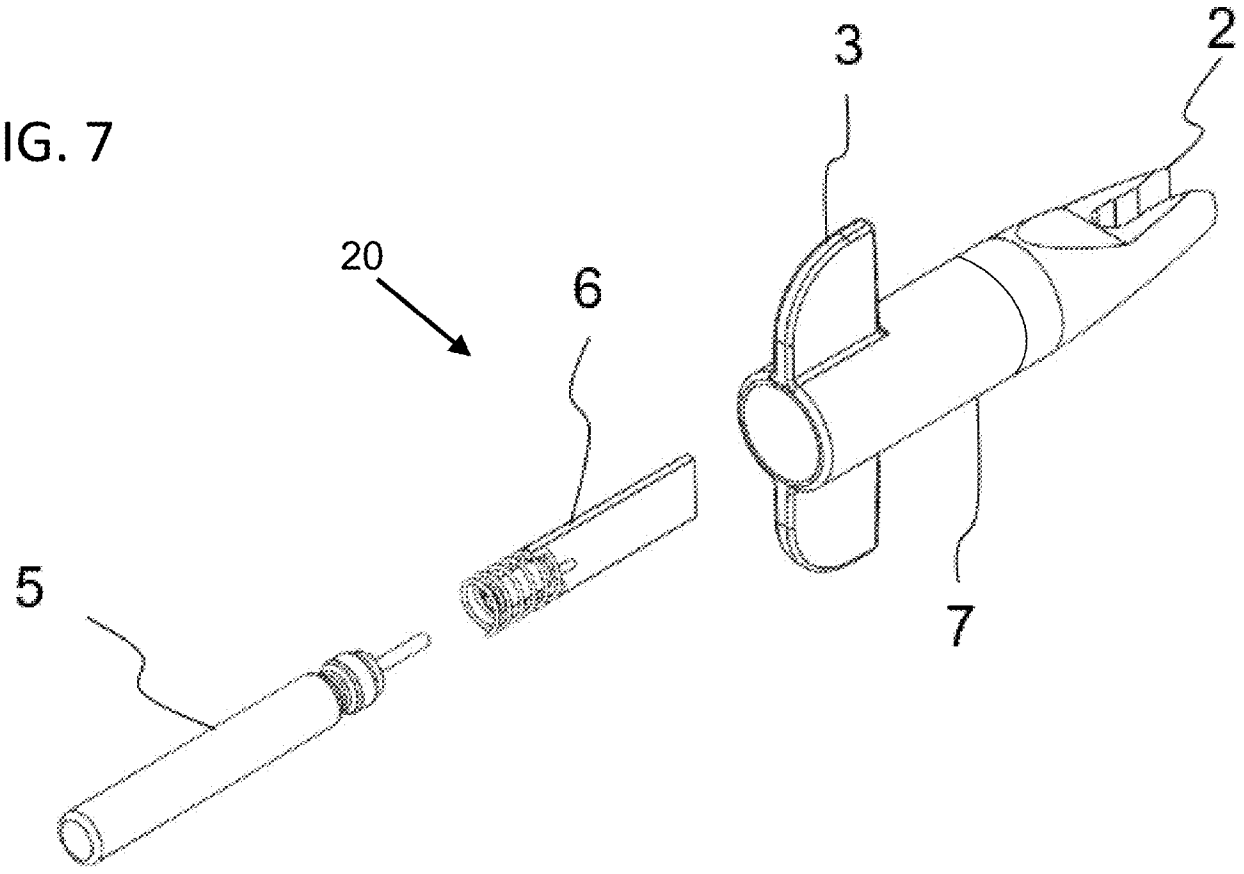
FIG. 7 is a perspective view of an embodiment of a detachable tracking apparatus ready for insertion into an arrow shaft.

For example, as depicted in FIGS. 5-7, an embodiment of a detachable tracking apparatus 20 can include a front section 1 that can include a securing component 4 which is configured for securing the detachable tracking apparatus 20 to a target. The front section 1 may be made out of aluminum, carbon, acrylic polymer, plastic or another suitable durable material that has a high tensile strength to weight ratio. Preferably the detachable tracking apparatus 20 connects to an arrow by the front section 1 of the detachable tracking apparatus 20 connecting to a rear end of the shaft of the arrow such that the detachable tracking apparatus 20 will detach from the arrow shaft upon target collision.

The pair of wings 132 can form a stopping component 3 configured for detaching the detachable tracking apparatus 20 from the arrow after the arrow collides with the target. The detachable tracking apparatus 20 can further comprise a pin nock assembly 2 which is configured to attach to the bow string. The detachable tracking apparatus 20 can further comprise a transmitting device that can comprise a power source 5 and a printed circuit board (PCB) 6. The rear section 7 of the detachable tracking apparatus 20 is preferably made out of a plastic polymer or other durable material that does not interfere with RF signal transmission.

The foregoing description has been presented for the purposes of illustration and description. It is not intended to be exhaustive or to limit the invention to the exemplary embodiments disclosed. Many modifications and variations are possible in light of the above teachings. It is intended that the scope of the invention be limited not by this detailed description of examples, but rather by the claims appended hereto.

The invention claimed is:

1. A pin nock assembly comprising:

a pin comprising a pin base, a pin element positioned laterally away from the pin base, and a pin collar positioned between the pin base and pin element, wherein the pin base has a pin base diameter;

the pin element protruding laterally from the pin collar along a central axis, the central axis extending from a center of the pin base through a center of the pin element; and a nock comprising a nock base and a string interface positioned laterally away from the nock base, wherein the nock base has a nock base diameter that is substantially similar to the pin base diameter;

the nock base defining a pin cavity complementary to and configured to receive the pin element, a base portion of the nock base is positioned around the pin cavity and is configured to abut the pin collar when the pin element is inserted into the pin cavity, and the string interface configured to contact a string of a crossbow.

2. The pin nock assembly of claim 1, wherein the string interface comprises a first nock ear and a second nock ear, the first nock ear extending from a first base end laterally away from the nock base toward a first ear end, and the second nock ear extending from a second base end laterally away from the nock base toward a second ear end, wherein the first base end and the second base end define an internal string cavity.

3. The pin nock assembly of claim 2, wherein the internal string cavity is configured to transfer a firing force from the string of the crossbow into the nock base and away from the string interface.

4. The pin nock assembly of claim 2, wherein the string interface is configured to removably couple with the string of the crossbow.

5. The pin nock assembly of claim 2, wherein the second ear end of the second nock ear is positioned axially away from the first ear end of the first nock ear to define an ear gap between an end of the first nock ear and an end of the second nock ear.

6. The pin nock assembly of claim 5, wherein the ear gap and/or the internal string cavity are substantially smooth and configured to minimize friction with the string of the crossbow.

7. The pin nock assembly of claim 1, wherein the pin nock comprises a material configured to withstand a firing force of the string of the crossbow.

8. The pin nock assembly of claim 1, wherein the nock base is configured to transfer a firing force from the string of the crossbow from the string interface to the pin collar.

9. The pin nock assembly of claim 1, wherein the pin base is coupled to a rear end of an arrow or bolt, the arrow or bolt is configured to be fired from the crossbow, and wherein the central axis extends through a tip of the arrow or bolt.

10. The pin nock assembly of claim 9, wherein the nock further comprises an indexing tab, the indexing tab configured to indicate an orientation of the nock in relation to the arrow or bolt.

11. The pin nock assembly of claim 9, wherein the pin is formed as a single unit with the arrow or bolt.

12. The pin nock assembly of claim 9, wherein a diameter of the pin nock is the same as a diameter of the arrow or bolt.

13. The pin nock assembly of claim 1, further comprising an illumination assembly configured to attach to the pin or nock, the illumination assembly comprising a light emitting element and at least one counterweight comprising a first counterweight, wherein the light emitting element and the at least one counterweight are positioned symmetrically from each other relative to the nock on opposite sides of the nock.

14. The pin nock assembly of claim 13, wherein the pin nock is translucent or transparent to allow light through from the light emitting element therethrough.

15. The pin nock assembly of claim 1, wherein the pin collar extends radially between the pin base and pin element and is perpendicular to central axis.

16. The pin nock assembly of claim 1, wherein the string interface is a flat surface that extends perpendicular to central axis.

17. The pin nock assembly of claim 1, wherein the pin nock is configured to emit at least one of a sound, light, smoke, and radio frequency.

18. The pin nock assembly of claim 1, wherein the pin nock comprises an adjustable weight.

19. The pin nock assembly of claim 1, wherein the pin nock comprises at least one integrated vane, the at least one integrated vane configured to stabilize an arrow or bolt when the arrow or bolt is fired from string of the crossbow.

20. A method of firing an arrow or bolt from a crossbow, the arrow or bolt comprising a shaft and a pin positioned on a rear end of the arrow or bolt, wherein a central axis of the arrow or bolt extends through a tip of the arrow or bolt and the pin, the pin comprising a pin base, a pin element positioned laterally away from the pin base, and a pin collar positioned between the pin base and pin element, the pin element protruding laterally from the pin collar along the central axis, comprising, attaching a nock to the pin so that pin element is inserted into a pin cavity of the nock, the nock comprising a nock base and a string interface positioned laterally away from the nock base, the nock base defining the pin cavity, and a base portion of the nock base positioned around the pin cavity and configured to abut the pin collar when the pin element is inserted into the pin cavity.

21. The method of claim 20, wherein the string interface comprises a first nock ear and a second nock ear, the first nock ear extending from a first base end laterally away from the nock base toward a first ear end, and the second nock ear extending from a second base end laterally away from the nock base toward a second ear end, wherein the first base end and the second base end define an internal string cavity, comprising inserting a string of the crossbow into the internal string cavity, and cocking the crossbow.

22. The method of claim 21, comprising firing the arrow or bolt from the crossbow, wherein the internal string cavity is configured to transfer a firing force from the string of the crossbow into the nock base and away from the string interface.

* * * * *